US009049899B2

(12) United States Patent
Reuben

(10) Patent No.: US 9,049,899 B2
(45) Date of Patent: Jun. 9, 2015

(54) ARTICLE OF FOOTWEAR

(71) Applicant: Ronie Reuben, Montreal (CA)

(72) Inventor: Ronie Reuben, Montreal (CA)

( * ) Notice: Subject to any disclaimer, the term of this patent is extended or adjusted under 35 U.S.C. 154(b) by 216 days.

(21) Appl. No.: 13/815,049

(22) Filed: Jan. 28, 2013

(65) Prior Publication Data

US 2014/0208618 A1 Jul. 31, 2014

(51) Int. Cl.
*A43B 23/00* (2006.01)
*A43B 7/08* (2006.01)
*A43B 23/02* (2006.01)

(52) U.S. Cl.
CPC ..... *A43B 7/085* (2013.01); *A43B 23/022* (2013.01); *A43B 23/0225* (2013.01); *A43B 23/027* (2013.01)

(58) Field of Classification Search
CPC ..... A43B 7/06; A43B 7/08; A43B 7/085; A43B 23/0265; A43B 23/027
See application file for complete search history.

(56) References Cited

U.S. PATENT DOCUMENTS 312,675 A * 2/1885 Turner ..... 36/51
330,176 A * 11/1885 Walker ..... 36/51
607,573 A * 7/1898 Piessens ..... 36/51
911,025 A * 2/1909 Blaisdell ..... 36/51
968,964 A * 8/1910 Lutz ..... 36/50.1
1,885,297 A * 11/1932 Santori ..... 36/51
2,076,501 A * 4/1937 Larroque ..... 24/436
2,097,810 A * 11/1937 Dawes ..... 36/51
3,507,057 A * 4/1970 Olsson ..... 36/86
2001/0000272 A1* 4/2001 Attilieni ..... 36/3 A
2001/0001903 A1* 5/2001 Di Girolamo ..... 36/3 R
2001/0042324 A1* 11/2001 Filice ..... 36/115
2005/0241179 A1* 11/2005 Chen ..... 36/3 A
2008/0028640 A1* 2/2008 Lacorazza ..... 36/97
2008/0083138 A1* 4/2008 Lacorazza et al. ..... 36/97
2009/0014424 A1* 1/2009 Meschter ..... 219/121.69
2012/0180339 A1* 7/2012 Izquieta Anaut ..... 36/102

* cited by examiner

*Primary Examiner* — Marie Bays

(74) *Attorney, Agent, or Firm* — Guy J. Houle; Houle Patent Agency

(57) ABSTRACT

A flexible article of footwear is comprised of a footwear upper secured to a waterproof sole having a toe portion. The footwear upper has a waterproof toe portion, an arch portion and an ankle portion. A flexible bank is secured between the toe portion and the arch portion. The flexible band has at least a forward angulated section to provide for the arch portion to flex forwardly and laterally to alleviate resistance by the article of footwear on the foot of the wearer person during use.

8 Claims, 1 Drawing Sheet

FIG. 1
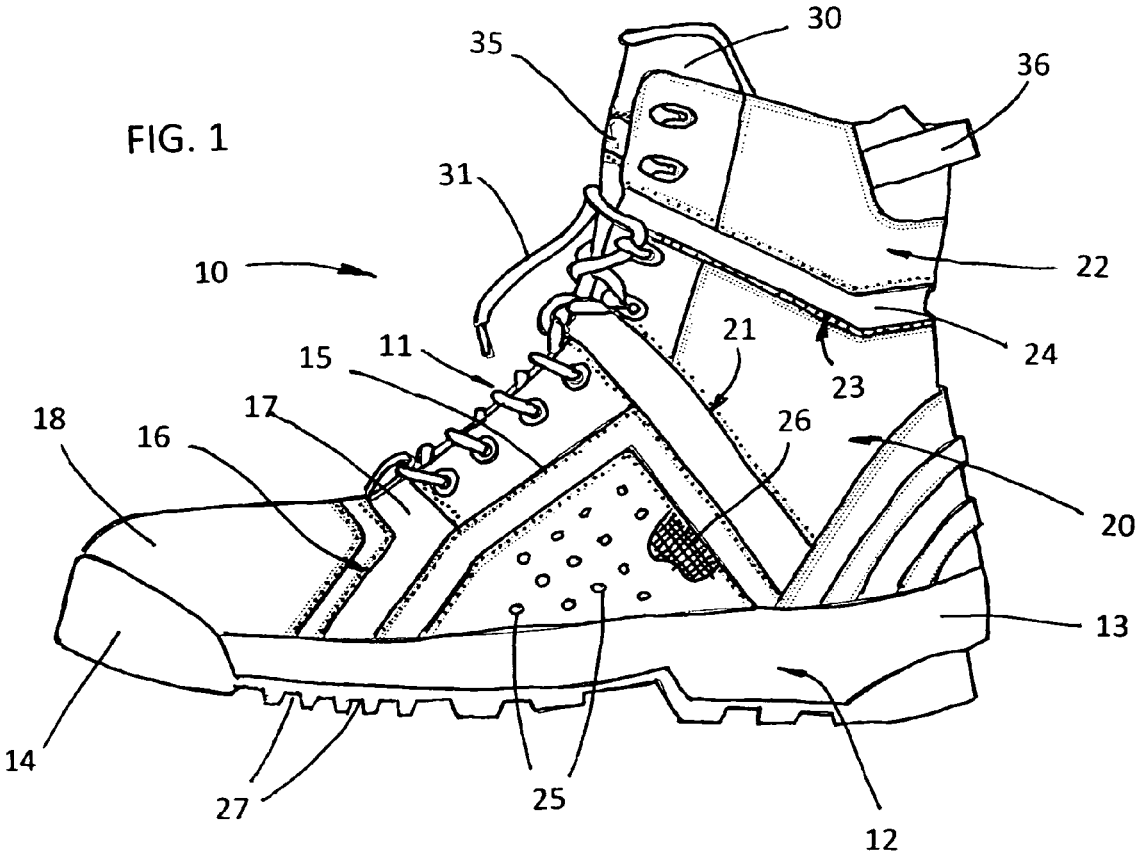
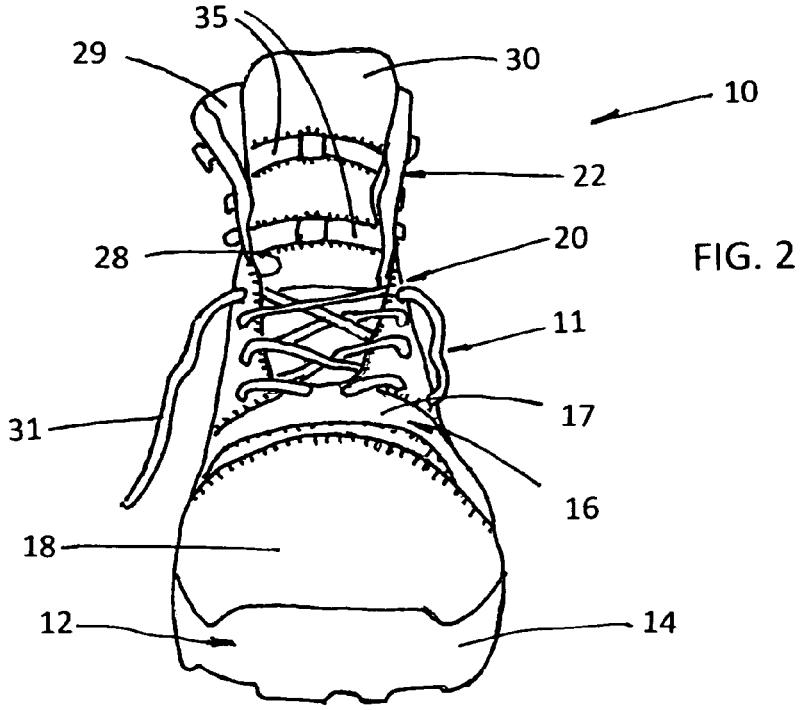
FIG. 2

ARTICLE OF FOOTWEAR

TECHNICAL FIELD

The present invention relates to a flexible article of footwear which provides forward and lateral flexibility during use.

BACKGROUND ART

When articles of footwear are worn for several hours, they are often uncomfortable to the wearer person due to the fact that they do not provide sufficient flexibility and breathability during walking or running activity. Some article of footwear, such as boots, are usually made of stiff construction materials and therefore they cause irritation to the foot of the wearer person. Also, many of these boots do not evacuate moisture and are not waterproof due to their construction and materials thereby causing the foot to sweat and becoming wet by the infiltration of water, mud, etc. and sometimes resulting in foot disease. Because boot uppers are usually constructed of stiff designs, and particularly their sole portion, they are not suitable for sports activities. Further many athletic shoes fail in providing suitable flexibility and breathability.

Generally, boots are not intended to be worn for running activity. Accordingly, their hard non-flexible sole does not provide sufficient flexibility in the toe portion and this stresses the foot when wearing boots. During a running activity the arch section of the foot of a wearer person tends to aggressively pivot on its toe section but the sole and the boot upper offers resistance against this foot movement.

SUMMARY OF INVENTION

It is an object of the present invention to provide a flexible article of footwear which substantially overcomes all of the above disadvantages of the prior art.

Another object of the present invention is to provide a flexible and breathable boot which can be worn for long hours while providing comfort.

Another object of the present invention is to provide a flexible and breathable multipurpose boot which has flexible bands in the boot upper constructed with a waterproof and breathable membrane which allows air and vapor to escape out of the boot while preventing the ingress of water to the exterior into the boot.

A still further object of the present invention is to provide a flexible and breathable article of footwear having one or more flexible bands strategically disposed in its construction and each band having a forward angulated section to provide forward and lateral flexibility to alleviate resistance of the boot on the foot of the wearer person during use.

Another object of the present invention is to provide an article of footwear and wherein the sole is provided with transverse pivot enhancing slots behind the toe section thereof to provide forward flexing of the foot arch portion on the toe section, such as when running.

According to the above noted objects, the present invention provides a flexible article of footwear constructed with an upper secured to a waterproof sole. The upper has a waterproof toe portion, an arch portion and an ankle portion. A flexible and stretchable band is secured between the toe portion and the arch portion. The flexible and stretchable band has at least a forward angulated section to provide for the arch portion to flex forwardly and laterally to alleviate resistance by the article of footwear on the foot of the wearer person during use.

According to the present invention there are two or more strategically disposed flexible and stretchable bands.

According to the present invention the bands are constructed of material which is flexible and stretchable and waterproof.

According to the present invention the article of footwear has a sole with pivot enhancing slots disposed behind the toe section thereof.

According to the present invention the article of footwear is a boot or a shoe wearable for normal use or commercial and industrial activity, sports activity or for military and the like uses.

BRIEF DESCRIPTION OF DRAWINGS

The present invention will now be described with reference to the accompanying drawings wherein:

FIG. 1 is a side view of an article of footwear, herein a boot, constructed in accordance with the present invention, and FIG. 2 is a front view of FIG. 1 illustrating the construction of the tongue and the flexible fastening lace of the boot.

DESCRIPTION OF PREFERRED EMBODIMENTS

Referring now to FIGS. 1 and 2, there is shown generally at 10, an example of an article of footwear constructed in accordance with the present invention. The article of footwear 10 is a boot which is comprised of a boot upper 11 which is immovably secured to a waterproof sole 12 having a heel portion 13 and a toe portion 14 integrally formed therewith.

The boot upper 11 has an arch portion 15. A flexible and stretchable band 16 is secured between the toe section 18 of the boot upper 11 and the arch portion 15. The flexible and stretchable band 16 has at least a forward angulated section 17 to provide for the arch portion 15 to flex forwardly and laterally to alleviate resistance by the boot construction on the foot of the wearer person during use.

It is pointed out that the flexible article of footwear 10 of the present invention need not be a boot as illustrated in the embodiment depicted by FIGS. 1 and 2, but can be a shoe wherein the upper 11 terminates below the ankle of the foot of the wearer person. In such an embodiment, there may be but a single flexible and stretchable band 16 provided between the toe section 18 and the arch portion 15. Additionally, there could also be provided a second flexible and stretchable band 21 extending forwardly from below the ankle portion 20 above the heel portion 13 of the sole 12 and terminating in a shoe opening.

The boot upper 11, as illustrated in FIGS. 1 and 2, has an upper collar portion 22 formed integral with the ankle portion 20 and extending thereabove. As shown, a third flexible and stretchable band 23 is secured between the ankle portion 20 and the upper collar portion 22 and it also has a forward angulated section 24 to provide for the ankle portion 20 and collar portion 22 to flex forwardly and laterally to alleviate resistance by the boot construction on the foot of the wearer person. These bands may also be waterproof.

In order to provide additional comfort to the boot construction or a shoe construction as mentioned above, the arch portion 15 may be provided with vent holes 25 on the medial side of the boot. These vent holes 25 are in registry with a waterproof and breathable membrane 26 secured to the outer skin of the boot behind the vent holes. Such a construction permits air and water vapor to escape out of the boot while preventing water from penetrating into the boot. The boot outer skin may be fabricated with various materials such as leather or suitable flexible synthetic material as is well known to a person skilled in the art of footwear fabrication.

To provide further flexibility of the boot 10, the forward portion of the boot upper 11 and particularly in the area of the flexible and stretchable bands, the waterproof sole 12 is provided with a plurality of transverse slots 27 extending between opposed sides of the sole 12 in a forward portion thereof behind the toe portion 14. These transverse slots 27 provide for a flexible forward boot support under the toe section 16 to enhance and facilitate forward flexing of the arch portion 15 on the toe section of the boot or shoe, particularly during a running activity. This is particularly advantageous in all sorts of applications where articles of footwear are really not intended for running activity, such as for hiking boots or shoes, industrial boots, security or military boots, etc. However, a need may arise where such wearer person may find itself in a situation where there is a pressing need to run and often for long distances. The waterproof sole 12 is a rubber sole constructed of VA or BU material.

The boot 10 shown in FIGS. 1 and 2, has a foot entry opening 28 extending from behind the flexible band 16 to an open top end 29 of the upper collar portion 22. A flexible tongue 30 is secured at the base of the entry opening 28 there behind and project beyond the entry opening 29. Fastening means in the form of laces 31 secures the entry opening with the tongue 30 comfortably trapped there behind on the forward upper foot section of the wearer person. However, to provide additional flexibility to the boot 10 or shoe, the lace 31 is constructed of stretchable material. The fastening means may also be provided in different forms such as by a stretchable strap(s) or rigid buckle(s) secured to stretchable attachments.

The flexible tongue 30 is herein shown as provided with a pair of flexible and stretchable bands 35 extending laterally there across and also providing for forward and lateral flexibility when secured across the forward lower portion of the leg of a wearer person by the stretchable lace 31. Each of the bands 35 are disposed aligned with a respective one of the stretchable bands 21 and 23 wherein the entire front portion of the boot 10 can bend forward without undue resistance against the wearers foot. The stretchable lace 31 also provides stretching with the bans. As herein shown the upper collar portion 22 terminates in an athletic profile design and is provided with a rear pull loop 36 to facilitate the entry of the foot in the top open top end 29 of the boot. The waterproof membrane 26 is also of a type well known in the art and may be constructed of the same material as the flexible and stretchable bands 17, 21 and 23. These bands may be constructed of a material known by the registered trademark Schoeller which contains 3% EL, 12% PU and 85% PA. The flexible bands may also be constructed from a composite material having 33% Kevlar (registered trademark) 8% EL, 18% PU and 41% PA. It is also pointed out that all of the boot/shoe stitching may have a waterproof seam sealing tape disposed there along on the inside wall of the boot.

It can be appreciated that an article of footwear constructed in accordance with the present invention may have a multitude of designs, such as the boot described above, and still provide advantageous comfort to all sorts of user persons, such as for leisure, sports, construction workers, security and even the military, as examples, where such persons are required to wear boots for long periods of time. The article of footwear of the present invention, in its various forms, provides increase flexibility, breathability and comfort.

It is pointed out that various obvious modifications of the article of footwear of the present invention are intended to be covered provided that such are interpretable within the scope of the claims defining the boundaries of the present invention.

The invention claimed is:

1. A flexible boot comprising a boot upper secured to a waterproof sole having a heel portion, said footwear upper having a waterproof toe portion, an arch portion and an ankle portion, a flexible and stretchable band secured between said toe portion and said arch portion, said flexible band having a forward angulated section to provide for said arch portion to flex forwardly and laterally to alleviate resistance by said article of footwear on the foot of a wearer person during use, said boot upper having a neck portion having an upper collar portion, and a second flexible band between said arch portion and said ankle portion, and wherein a third flexible band is provided between said ankle portion and said upper collar portion, said second and third flexible bands also having a forward angulated section to provide for said ankle and collar portion to flex forward and laterally to alleviate resistance by said boot upper on the foot of said wearer person.

2. A flexible boot as claimed in claim 1 wherein said arch portion has vent holes on a medial side and a waterproof breathable membrane secured behind said vent holes to allow air and vapor to move out of said boot through said vent holes while preventing the ingress of water to the exterior of said boot.

3. A flexible boot as claimed in claim 1 wherein said waterproof sole is further provided with a plurality of transverse slots in a forward portion of said sole behind said toe portion to provided for a flexible forward pivotal sole section behind said toe portion to provide forward flexing of said arch portion.

4. A flexible boot as claimed in claim 3 wherein said waterproof sole is a rubber sole.

5. A flexible boot as claimed in claim 1 wherein said boot has a forward foot entry opening extending from behind said flexible band between said toe portion and said arch portion to an open top end of said collar portion, and a flexible tongue secured at a base of said entry opening and extending beyond said entry opening and therealong, fastening means to secure said foot entry opening, said flexible tongue having flexible band sections forming a part thereof and disposed to co-extensive alignment with said second and third flexible bands.

6. A flexible boot as claimed in claim 5 wherein said fastening means is a flexible and stretchable fastening means.

7. A flexible boot as claimed in claim 6 wherein said fastening means is one of a stretchable lace, a stretchable strap or a buckle or zipper having stretchable connections.

8. A flexible boot as claimed in claim 1 wherein said first, second and third flexible bands are formed of a breathable material.

* * * * *